US007967970B2

(12) United States Patent
Gronvold

(10) Patent No.: US 7,967,970 B2
(45) Date of Patent: Jun. 28, 2011

(54) METHOD FOR THE CATHODIC PROTECTION OF THE REINFORCEMENTS OF FERROCONCRETE EDIFICES AGAINST CORROSION

(75) Inventor: Frits O. Gronvold, Vallensbaek (DK)

(73) Assignee: PCI Augsburg GmbH, Augsburg (DE)

( * ) Notice: Subject to any disclaimer, the term of this patent is extended or adjusted under 35 U.S.C. 154(b) by 391 days.

(21) Appl. No.: 11/988,260

(22) PCT Filed: Jul. 3, 2006

(86) PCT No.: PCT/EP2006/006457

§ 371 (c)(1),
(2), (4) Date: Apr. 2, 2009

(87) PCT Pub. No.: WO2007/003396

PCT Pub. Date: Jan. 11, 2007

(65) Prior Publication Data

US 2009/0200179 A1 Aug. 13, 2009

(30) Foreign Application Priority Data

Jul. 5, 2005 (DE) ..... 10 2005 031 350

(51) Int. Cl.
*C23F 13/00* (2006.01)

(52) U.S. Cl. ..... 205/734

(58) Field of Classification Search ..... 205/734
See application file for complete search history.

(56) References Cited

U.S. PATENT DOCUMENTS

| | | | | |
|---|---|---|---|---|
| 5,183,694 | A | 2/1993 | Webb et al. | |
| 5,292,411 | A * | 3/1994 | Bartholomew et al. | 205/731 |
| 5,650,060 | A | 7/1997 | Huang et al. | |
| 6,217,742 | B1 * | 4/2001 | Bennett | 205/734 |
| 7,276,144 | B2 * | 10/2007 | Whitmore | 205/734 |

FOREIGN PATENT DOCUMENTS

| | | |
|---|---|---|
| GB | 2389591 | 12/2003 |
| WO | WO-03/027356 A1 | 4/2003 |

OTHER PUBLICATIONS

International Search Report for Application No. PCT/EP2006/006457, dated Jul. 30, 2007.

* cited by examiner

*Primary Examiner* — Bruce F Bell
(74) *Attorney, Agent, or Firm* — McCarter & English, LLP

(57) ABSTRACT

Disclosed is a method for the cathodic protection (KKS) of the reinforcements of ferroconcrete edifices against corrosion. According to said method, a) one side of the structural joints of the concrete supporting elements is sealed, b) the KKS anodes are introduced into the structural joints, c) an ionically conductive gel is introduced into the joints that are closed on one side, and d) the structural joints are optionally sealed as a whole. Surprisingly, the required electrical conductivity can be reliably ensured during the entire application period with the aid of the ionically conductive gel, which is a prerequisite for effectively and reliably protecting the steel reinforcements of concrete structures against corrosion.

15 Claims, No Drawings

METHOD FOR THE CATHODIC PROTECTION OF THE REINFORCEMENTS OF FERROCONCRETE EDIFICES AGAINST CORROSION

RELATED APPLICATIONS

This application is a 35 U.S.C. 371 national stage filing of International Application No. PCT/EP2006/006457, filed Jul. 3, 2006, which claims priority to German Patent Application No. 10 2005 031 350.7 filed on Jul. 5, 2005. The contents of these applications are hereby incorporated by reference in their entireties.

The present invention relates to a method for the cathodic protection of the reinforcements of ferroconcrete edifices against corrosion, in particular in the region of expansion and movement joints.

The stability against collapse and the service life of ferroconcrete edifices are substantially dependent on the protection of the used reinforcing steel against corrosion. The natural alkalinity of the concrete normally leads to the passivation of steel surfaces and thus corrosion is generally ruled out. However, the influence of carbon dioxide from the air can lead to so-called carbonation, whereby carbon dioxide from the atmosphere dissolves in the moist cement stone and forms carbonic acid. As a result, the alkalinity of the concrete is reduced since calcium hydroxide is hereby converted into calcium carbonate.

As soon as this progressive process reaches the reinforcing steel (which occurs relatively quickly in the case of reinforcements with only a thin covering), the rust-inhibiting and corrosion-inhibiting passivation film of the reinforcing steel is destroyed. In the presence of water and oxygen, oxidation products of the reinforcing steel are formed. The structure of the steel is thereby destroyed; the large volume of oxidation products furthermore leads to the formation of cracks in the concrete and to spalling.

In addition to carbon dioxide, the passivation layer of the reinforcing steel in the concrete can also be destroyed by the presence of chlorides. Chlorides such as those used, for example, as de-icing salts, can penetrate concrete and cause corrosion of reinforcing steel even under highly alkaline conditions. The probability of corrosion thereby increases with the amount of chloride. Chloride corrosion can also only take place if there is sufficient water and oxygen in the vicinity of the reinforcing steel.

There are therefore different methods for protecting ferroconcrete edifices against corrosion, for example by subsequently coating the reinforcing steel with corrosion-inhibiting coatings or by impregnation with chemicals that also prevent rust.

A further possibility for preventing/minimising corrosion of reinforcements is to protect the structure itself against moisture penetration. This can be done by means of waterproof coatings or impregnations. In particular the application of so-called hydrophobing agents (silane/polysiloxane solutions) to the surface of the concrete is prior art. The disadvantage hereof is that these are not impermeable to water vapour/$CO_2$ and they can thus only slow down the described processes of carbonation, but cannot prevent them completely. Furthermore, these coatings/impregnations must be renewed again and again in order to permanently ensure their effectiveness.

So-called cathodic corrosion protection (CCP) has been established as an electrochemical method for more than 30 years. As already described above, partial corrosion of the steel reinforcements occurs if unfavourable parameters (chloride pollution, carbonation) exist. The corrosion site thereby forms the anode and the adjacent, not yet corroded steel forms the cathode, i.e. a corrosion current flows in the concrete. This leads to further accelerated corrosion of the reinforcing steel. The metal dissolution thereby forms the anodic partial reaction and oxygen reduction forms the cathodic partial reaction.

The principle of CCP is based on the fact that the anodic partial reaction, i.e. the iron dissolution, is prevented by an opposite direct current flow. By applying a protective current, the reinforcing steel is thereby polarised, i.e. the steel/concrete potential is shifted in the negative direction. This type of corrosion protection is therefore also referred to as cathodic corrosion protection.

The required protective current can be implied in the case of CCP by different systems. One possibility is the use of so-called discrete anodes. These are introduced in the concrete in the vicinity of the steel reinforcements. The steel/concrete potential is shifted via these in the required negative direction by applying an external direct current source.

In order for the method to work, it is important that the anodes are disposed in the direct vicinity of all of the reinforcing steel bars. This can be achieved relatively well in those regions in which the reinforcing steel is introduced close to the surface of the concrete (for example road surfaces).

However, in those regions where the steel reinforcements are introduced deeper into the concrete parts, this is linked with considerable effort. This is in particular the case in regions of concrete beam parts since these are generally separated by so-called structural joints. These structural joints are superficially sealed by means of sealing materials in order to prevent the penetration of moisture and salts (de-icing salt in the case of road surfaces). However, the penetration of water and salts occurs very often in practice owing to leaks in these seals, and this leads to the corrosion of the reinforcement in the beams. In order to achieve reliable protection here using CCP-cathodic corrosion protection, it is prior art to make deep drill holes on both sides of the structural joints and to insert the corresponding anodes herein. In order to accommodate the anodes or rod anodes, drill holes have to be made on both sides, generally every 20 to 30 cm. Particular attention must thereby be paid that the drill hole is made in the direct vicinity of the reinforcement and that the reinforcement is not damaged when doing so since otherwise a short circuit could occur and the method would become ineffective.

In the cathodic corrosion protection method, the reinforcement itself acts as the cathode and is therefore not allowed to come into direct contact with the rod anode. This method is very labour- and thus cost-intensive.

According to GB 2 389 591 A, it was proposed to connect the anodes with a deformable, preferably ductile (for example polyurethane-based) polymer material and to then press the anodes together with the deformable material into the structural joints of concrete construction components in order to produce an electrical contact with the surface of the concrete in this manner.

This method is also relatively time-consuming and cost-intensive. Furthermore, the reliability of the corresponding method is not ensured in a satisfactory manner over the entire period of use.

The object of the present invention was therefore to develop a method for the cathodic protection of the reinforcements of ferroconcrete edifices against corrosion, which does not have the cited disadvantages of the prior art but which rather enables a cost-effective and reliable method for the cathodic corrosion protection of the steel reinforcements of concrete structures.

This object was solved according to the invention in that a) one side of the structural joints of the concrete beam parts is sealed, b) the CCP anodes are introduced into the structural joints, c) an ionically conductive gel is introduced into the joints that are closed on one side, and d) the structural joints are optionally completely sealed.

It has surprisingly shown that by means of the ionically conductive gel, the required electric conductivity can be reliably ensured over the entire period of use, which is a basic requirement for effectively and reliably protecting the steel reinforcements of concrete structures against corrosion.

The method according to the present invention therefore comprises at least three steps. In the first step a), one side of the structural joints of the concrete beam parts is sealed, with this sealing of the joints preferably being carried out using chemical-resistant sealants, a specially adapted joint profile or an adhering joint tape.

Silicone-based, polyurethane-based, acrylate-based, silyl-modified polymer (SMP)-based, bitumen-based, MS polymer-based, epoxide-based and polysulfide-based products can be used as the chemical-resistant sealants. The joint tapes, which are preferably used in the form of fabric tapes, can be made of the same materials as the sealants. However, rubber mixtures such as silicone-rubber, acryl-rubber and bitumen-rubber are to be regarded as preferred. In this manner, the structural joints are sealed in water-tight manner on one side such that a liquid-tight gap for receiving the anodes is formed.

In the following step b), the CCP anodes are then introduced into the structural joints. The corresponding anodes can hereby be made of common materials such as, for example, so-called MMO (mixed metal oxide)-anodes, activated titanium metal anodes, platinised niobium metal anodes or conductive ceramic, titanium-oxide-based anodes. The shape of the corresponding CCP anodes is largely unimportant. Band-shaped anodes (ribbon-mesh) can therefore easily be used, however CCP anodes in the form of rod anodes are preferably used in the method according to the invention.

It is to be seen as essential to the invention that in step b) an ionically conductive gel is introduced into the joints that are closed on one side. The task of the ionically conductive gel is to reliably ensure the necessary electric conductivity over the entire period of use. To do so, it has to have, inter alia, a high water retention capacity in order to prevent drying out and thus a loss in effectiveness.

The ionically conductive gel, which can be used in both (semi-)liquid and paste-like form, preferably consists of 10 to 90% by weight of a polyvalent alcohol, 0.1 to 20% by weight of stabilisers, 0.01 to 5% by weight of electrolyte, 0 to 50% by weight of inert fillers as well as water and, optionally, other additives in the form of thickening agents and preservatives or anti-foaming agents as the remainder.

Ethylene glycol, propylene glycol, 1,3 propane diol, 1,2 butane diol, 2,3 butane diol or glycerine is preferably used as the polyvalent alcohol.

Used as stabilisers are, in particular, water-soluble, ionic or non-ionic cellulose derivatives, such as methyl cellulose (MC), hydroxyethyl cellulose (HEC), methyl hydroxyethyl cellulose (MHEC), methyl hydroxypropyl cellulose (MHPC), microbially produced polysaccharides such as Welan gum, naturally occurring polysaccharides (hydrocolloids) isolated by extraction, such as alginates, xanthans, carrageenans, galactomannans.

Preferably used as the electrolytes are one or more easily water-soluble salts selected from the group of hydroxides, nitrites and nitrates of sodium, potassium, lithium, calcium and aluminium.

The inert fillers, which have a preferred particle size of 0.1 to 3 mm, consist, in particular, of calcium carbonate, quartz, aluminium oxide, barium sulphate and shale.

Following introduction of the ionically conductive gel into the joints that are closed on one side, the structural joints are optionally sealed completely in the final step d), for which purpose the chemical-resistant sealants, the specially adapted joint profiles or the adhering joint tapes as already described in step a) can be used. According to this preferred embodiment, it is supposed to be prevented that water is able to subsequently penetrate the structural joints.

The method according to the invention has the advantage that both sides of the ferroconcrete construction can be protected in the joint region with just one anode and that the danger of a short-circuit owing to an unintentional contact of the anode with the steel reinforcement of the concrete structures is ruled out from the outset.

Furthermore, a very low-cost and effective process for the cathodic protection of the steel reinforcements of concrete structures against corrosion is provided with the method according to the invention, which also works reliably over a longer period of use.

The following example should illustrate the invention in more detail.

EXAMPLE

The method according to the invention was carried out on a car park level consisting of pre-cast concrete floor parts and pre-cast concrete beam parts having steel reinforcement. It was presumed here that owing in particular to penetrating de-icing salt, the steel reinforcement lacked the necessary passivation layer in the region of the movement joint that is contingent upon construction, and thus slight corrosion of the beam parts was also assumed.

A joint tape (Thoroflex 200 of the firm Masterbuilders) having a width of about 20 cm was adhered to the structural joint in the region of the beam underside over a length of 15 m using an epoxide resin adhesive (Thoroflex 2000 adhesive of the firm Masterbuilders). A liquid-tight gap was thus formed. An ionically conductive gel was then introduced into the resulting gap up to about ¾ of the height of the gap. MMO primary anodes (Duranodes of the firm CPI-GK) were introduced into the gel at intervals of approximately 1 m along the structural joint such that the anodes were disposed in the bottom third of the gel layer.

The introduced gel had the following composition:

0.80% by weight xanthan-gum-based stabiliser
40.00% by weight ethylene glycol
0.03% by weight calcium nitrate
34.02% by weight water
0.15% by weight preservative
25.00% by weight filler The structural joints were then completely sealed from above using the aforementioned Thoroflex 200 sealing tapes (of the firm Masterbuilders). Measuring of the potential was carried out with Ag/AgCl reference electrodes. The measuring points herefor were selected in such a manner that these formed a net-like measuring area on the concrete beam surfaces adjacent to the movement joint at a distance to one another of 250 and 500 mm and along the 15 m long movement joint. Measurement of the potential before operating the anode system showed that values of <–300 mV were measured over the entire measurement area and thus that corrosion of the reinforcing steel was already present. A direct current having a voltage of 3 V and a current flow of 100 mA was applied to the MMO anodes, which corresponds approximately to the required current density of 10 to 15 mA/m2 of reinforcing steel. The current was applied to the anodes over a period of 2½ months. When the anode system was switched off, a slow shifting of the potential into the negative range was immediately observed.

Finally, the potential was determined over the entire measurement area when the current was switched on ("ON-potential") and 4½ hours after the current had been switched off ("Off-potential") using Ag/AgCl reference electrodes. According to EN 12 696, effectiveness is proven if the difference between the ON-Potential and the OFF-potential is at least 100 mV. The required potential difference was achieved at approximately 75% of the 52 measuring sites, and satisfactory corrosion protection thus exists.

The invention claimed is:

1. Method for the cathodic corrosion protection (CCP) of reinforcements of ferroconcrete edifices, comprising a) sealing one side of the structural joints of the concrete beam parts, b) introducing the CCP anodes into the structural joints, c) introducing an ionically conductive gel into the joints that are closed on one side, and d) optionally completely sealing the structural joints.

2. The method according to claim 1, wherein the sealing of the joints in steps a) and d) is carried out using chemical-resistant sealants, a specially adapted joint profile or an adhering joint tape.

3. The method according to claim 1, wherein the CCP anodes comprise at least one group of anodes selected from the group consisting of so-called MMO (mixed metal oxide)-anodes, activated titanium metal anodes, platinised niobium metal anodes and conductive ceramic, titanium-oxide-based anodes.

4. The method according to claim 1, wherein the CCP anodes are used in the form of rod anodes.

5. The method according to claim 1, wherein the conductive gel has a high water retention capacity.

6. The method according to claim 1, wherein the gel is used in liquid, semi-liquid or paste-like form.

7. The method according to claim 1, wherein the gel comprises 10 to 90% by weight of a polyvalent alcohol, 0.1 to 20% by weight of stabilisers, 0.01 to 5% by weight of electrolyte, 0 to 50% by weight of inert fillers as well as water and, optionally, other additives in the form of thickening agents and preservatives or anti-foaming agents as the remainder.

8. The method according to claim 7, wherein the polyvalent alcohol comprises at least one alcohol selected from the group consisting of ethylene glycol, propylene glycol, 1,3 propane diol, 1,2 butane diol, 2,3 butane diol and glycerin.

9. The method according to claim 7, wherein the stabiliser comprises at least one stabiliser selected from the group consisting of water-soluble, ionic or non-ionic cellulose derivatives, microbially produced polysaccharides, and naturally occurring polysaccharides (hydrocolloids) isolated by extraction.

10. The method according to claim 7, wherein the electrolyte comprises one or more easily water-soluble salt selected from the group consisting of hydroxides, nitrites and nitrates of sodium, potassium, lithium, calcium and aluminium.

11. The method according to claim 7, wherein the inert filler comprises at least one filler selected from the group consisting of calcium carbonate, quartz, aluminium oxide, barium sulphate and shale.

12. The method according to claim 11, wherein the inert fillers have a particle size of 0.1 to 3 mm.

13. The method according to claim 9, wherein the water-soluble, ionic or non-ionic cellulose derivatives comprise at least one derivative selected from the group consisting of methyl cellulose (MC), hydroxyethyl cellulose (HEC), methyl hydroxyethyl cellulose (MHEC) and methyl hydroxypropyl cellulose (MHPC).

14. The method according to claim 9, wherein the microbially produced polysaccharides comprise Welan gum.

15. The method according to claim 9, wherein the naturally occurring polysaccharides (hydrocolloids) isolated by extraction comprise at least one polysaccharide selected from the group consisting of alginates, xanthans, carrageenans, and galactomannans.

* * * * *